US011333155B2

(12) United States Patent
Huang et al.

(10) Patent No.: US 11,333,155 B2
(45) Date of Patent: May 17, 2022

(54) THERMAL MODULE

(71) Applicants: Jui-Min Huang, Taipei (TW); Chih-Wen Chiang, Taipei (TW); Chien-Chu Chen, Taipei (TW); Wei-Hao Lan, Taipei (TW); Ching-Ya Tu, Taipei (TW); Ken-Ping Lin, Taipei (TW)

(72) Inventors: Jui-Min Huang, Taipei (TW); Chih-Wen Chiang, Taipei (TW); Chien-Chu Chen, Taipei (TW); Wei-Hao Lan, Taipei (TW); Ching-Ya Tu, Taipei (TW); Ken-Ping Lin, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 142 days.

(21) Appl. No.: 16/595,486

(22) Filed: Oct. 8, 2019

(65) Prior Publication Data

US 2020/0400153 A1 Dec. 24, 2020

(30) Foreign Application Priority Data

Jun. 21, 2019 (TW) ..... 108121607

(51) Int. Cl.

| | |
|---|---|
| ***F04D 27/00*** | (2006.01) |
| ***F04D 25/02*** | (2006.01) |
| ***F04D 29/053*** | (2006.01) |
| ***F04D 29/42*** | (2006.01) |
| ***F04D 25/16*** | (2006.01) |
| ***F04D 25/08*** | (2006.01) |

(52) U.S. Cl.
CPC ..... *F04D 27/002* (2013.01); *F04D 25/02* (2013.01); *F04D 25/08* (2013.01); *F04D 25/166* (2013.01); *F04D 29/053* (2013.01); *F04D 29/4226* (2013.01)

(58) Field of Classification Search
None
See application file for complete search history.

(56) References Cited

U.S. PATENT DOCUMENTS 4,553,404 A * 11/1985 Malchow ..... F24F 1/027 415/148
10,517,190 B2 * 12/2019 Lin ..... F04D 29/305
(Continued)

FOREIGN PATENT DOCUMENTS

TW I558302 11/2016

*Primary Examiner* — Charles G Freay
(74) *Attorney, Agent, or Firm* — JCIPRNET

(57) ABSTRACT

A thermal module including a first body, a second body, a first fan assembly, a second fan assembly, and a shaft is provided. The first body and the second body are slidably connected to each other and form an accommodating space together. The first fan assembly is disposed in the accommodating space and has a first hub and a plurality of first fan blades. The first hub is connected to the first body. The second fan assembly is disposed in the accommodating space and has a second hub and a plurality of second fan blades, and the second hub is connected to the second body. The first hub and the second hub overlap each other. The shaft is pivotally disposed in the first body and the second body and is engaged with the first fan assembly and the second fan assembly.

15 Claims, 10 Drawing Sheets

(56) References Cited

U.S. PATENT DOCUMENTS

| | | | | |
|---|---|---|---|---|
| 2020/0004303 | A1* | 1/2020 | Lin | H05K 7/20209 |
| 2020/0309138 | A1* | 10/2020 | Tsai | F04D 29/281 |
| 2020/0355199 | A1* | 11/2020 | Tsai | F04D 29/329 |

* cited by examiner

100

THERMAL MODULE

CROSS-REFERENCE TO RELATED APPLICATION

This application claims the priority benefit of Taiwan application serial no. 108121607, filed on Jun. 21, 2019. The entirety of the above-mentioned patent application is hereby incorporated by reference herein and made a part of this specification.

BACKGROUND

Technical Field

The disclosure relates to a thermal module. More particularly, the disclosure relates to a thermal module capable of changing the volume of air flow.

Description of Related Art

As regards today's consumer electronic products, benefiting from improvement of the semiconductor manufacturing process, computation efficiency of the processing chips advances; nevertheless, the operational temperature gradually increases as well. When the temperature is excessively high, operational stability of the chips is affected, and it thus can be seen that a good heat dissipation effect is the key for electronic products nowadays. In the existing heat dissipation manner, a thermal module is installed on the housing most of the time, and the thermal module is configured to exhaust hot air in the machine body and draw cold air in, so as to perform heat dissipation to the processing chip through air convection, and that the operational temperature may maintain to be stable.

Nevertheless, the existing consumer electronic products such as computers, handheld devices and the like are developed to be light and thin so as to feature easy portability. Such light and thin design also means that the internal space inside an electronic product reduces, so that a thermal module having greater heat dissipation efficiency may not be disposed in such a reduced space. When a thermal module having smaller volume is adopted, the required heat dissipation efficiency may not be satisfied. Therefore, development of a thermal module which satisfies the demand for miniaturization and exhibits high heat dissipation efficiency is an important goal.

SUMMARY

The disclosure provides a thermal module adapted to perform relative movement to adjust a thickness dimension, so that air intake is changed, and the demand for miniaturization is satisfied and the goal of high heat dissipation efficiency is achieved.

A thermal module provided by an embodiment of the disclosure includes a first body, a second body, a first fan assembly, a second fan assembly, and a shaft. The first body and the second body are slidably connected to each other and form an accommodating space together. The first fan assembly is disposed in the accommodating space and has a first hub and a plurality of first fan blades. The first hub is connected to the first body. The second fan assembly is disposed in the accommodating space and has a second hub and a plurality of second fan blades, and the second hub is connected to the second body. The first hub and the second hub overlap each other. The shaft is pivotally disposed in the first body and the second body and is engaged with the first fan assembly and the second fan assembly.

The shaft is adapted to pivot relative to the first body and the second body to drive the first fan assembly and the second fan assembly to synchronously rotate. The first body and the second body are adapted to receive an external force to relatively slide and drive the first fan assembly and the second fan assembly to oppositely move along the shaft to be switched to a folded state or an unfolded state.

To sum up, in the thermal module provided by the disclosure, the first body and the second body are adapted to relatively slide, so as to respectively drive the first fan assembly and the second fan assembly to oppositely move along the shaft. When the thermal module is switched to the folded state, the cross-sectional area of the accommodating space is reduced and the first fan assembly and the second fan assembly overlap each other, so that the demand for miniaturization is achieved. When the thermal module is switched to the unfolded state, the cross-sectional area of the accommodating space is expanded and the first fan assembly and the second fan assembly separate each other, so that air intake increases and the demand for high heat dissipation efficiency is achieved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
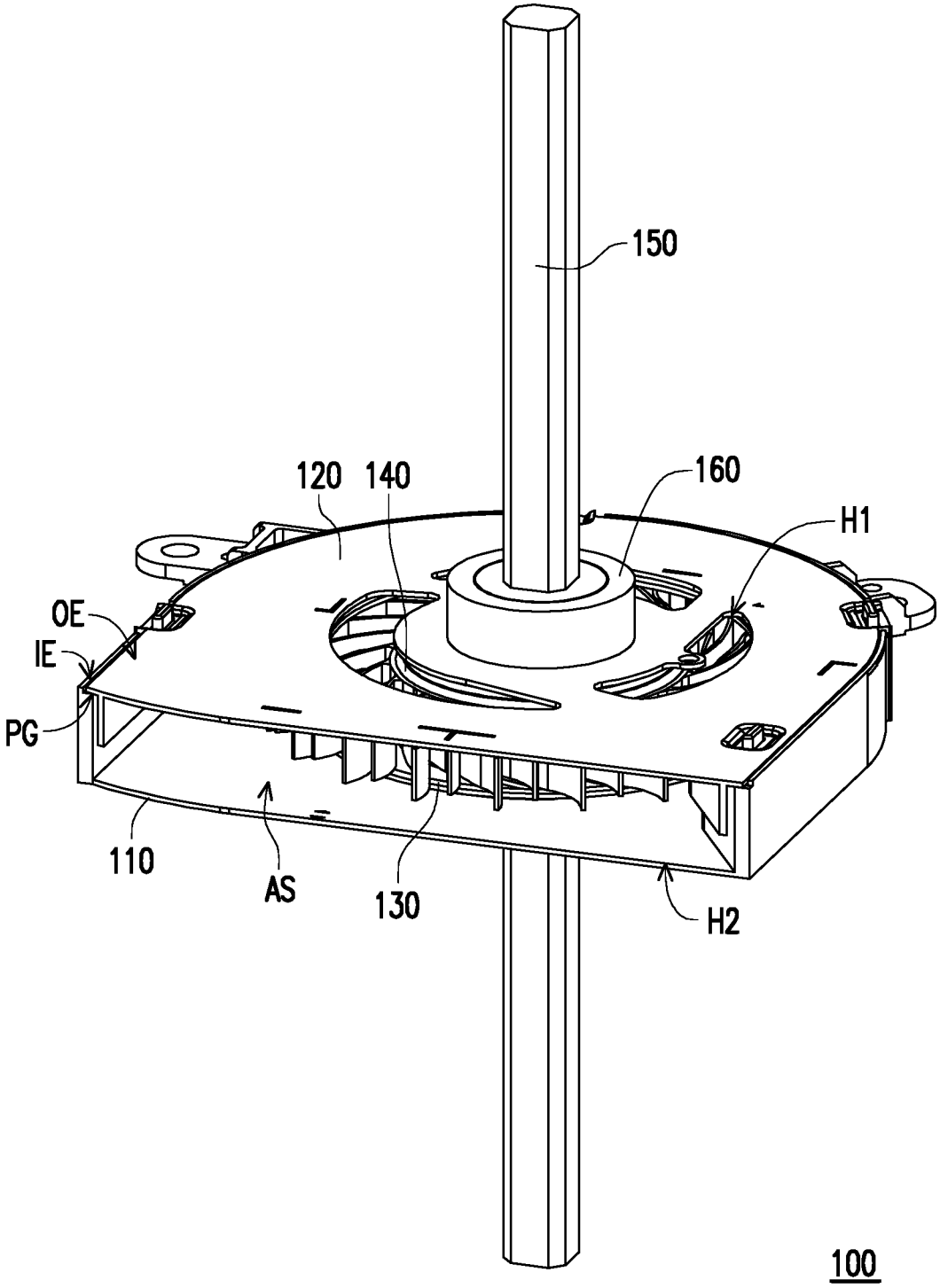
FIG. 1A is a schematic three-dimensional view of a thermal module according to an embodiment of the disclosure.
Figure 1B:
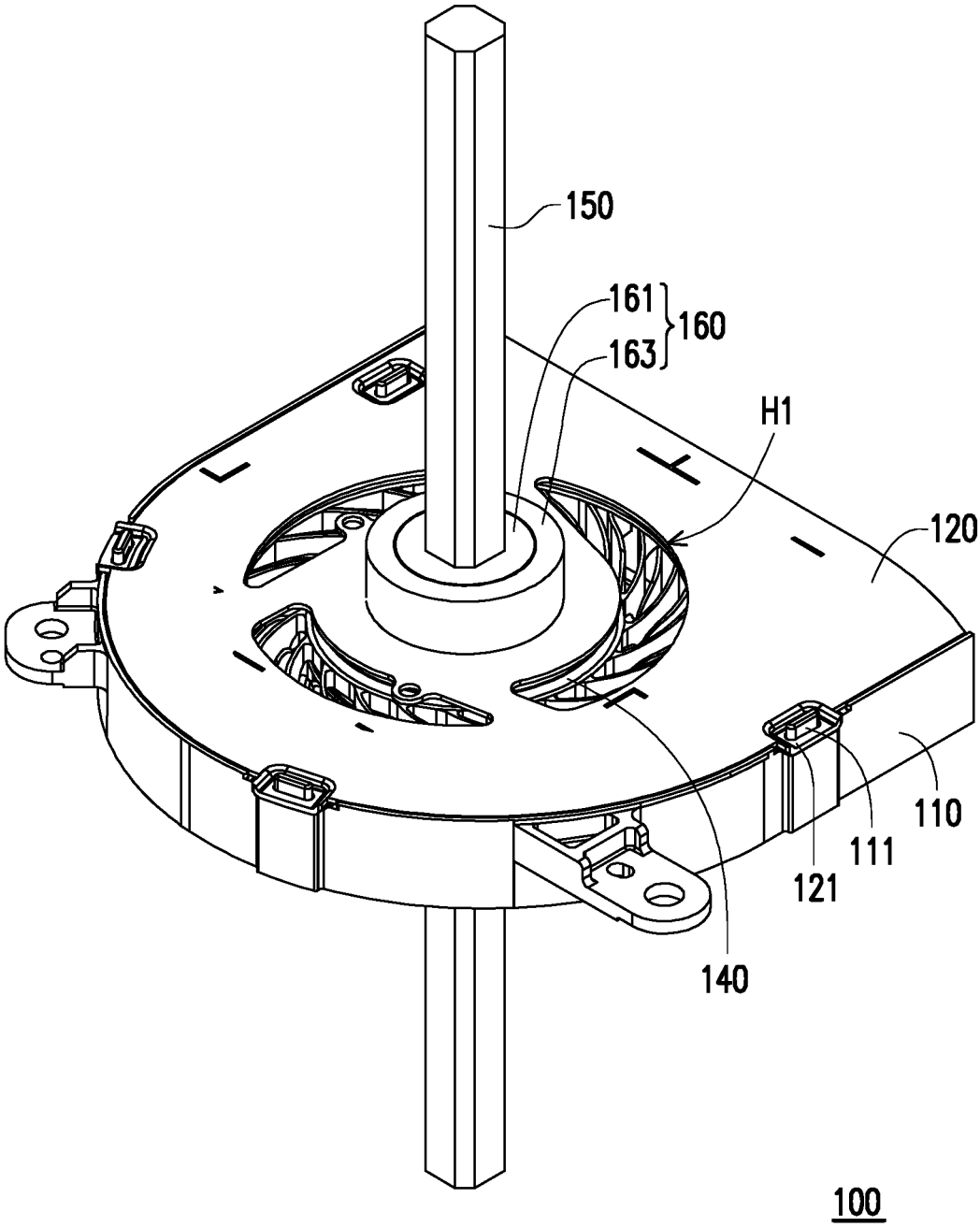
FIG. 1B is a three-dimensional view of the thermal module of FIG. 1A in another direction.
Figure 1C:
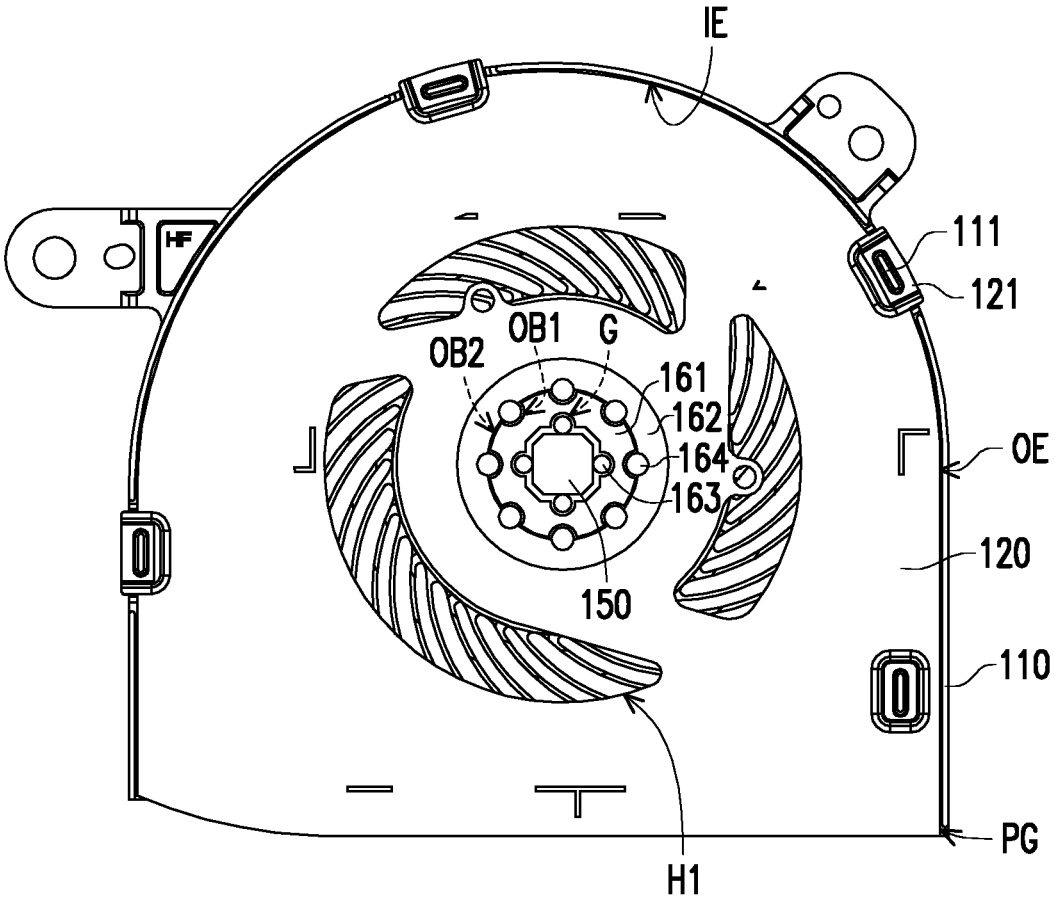
FIG. 1C is top plan view of the thermal module of FIG. 1A.
Figure 2A:
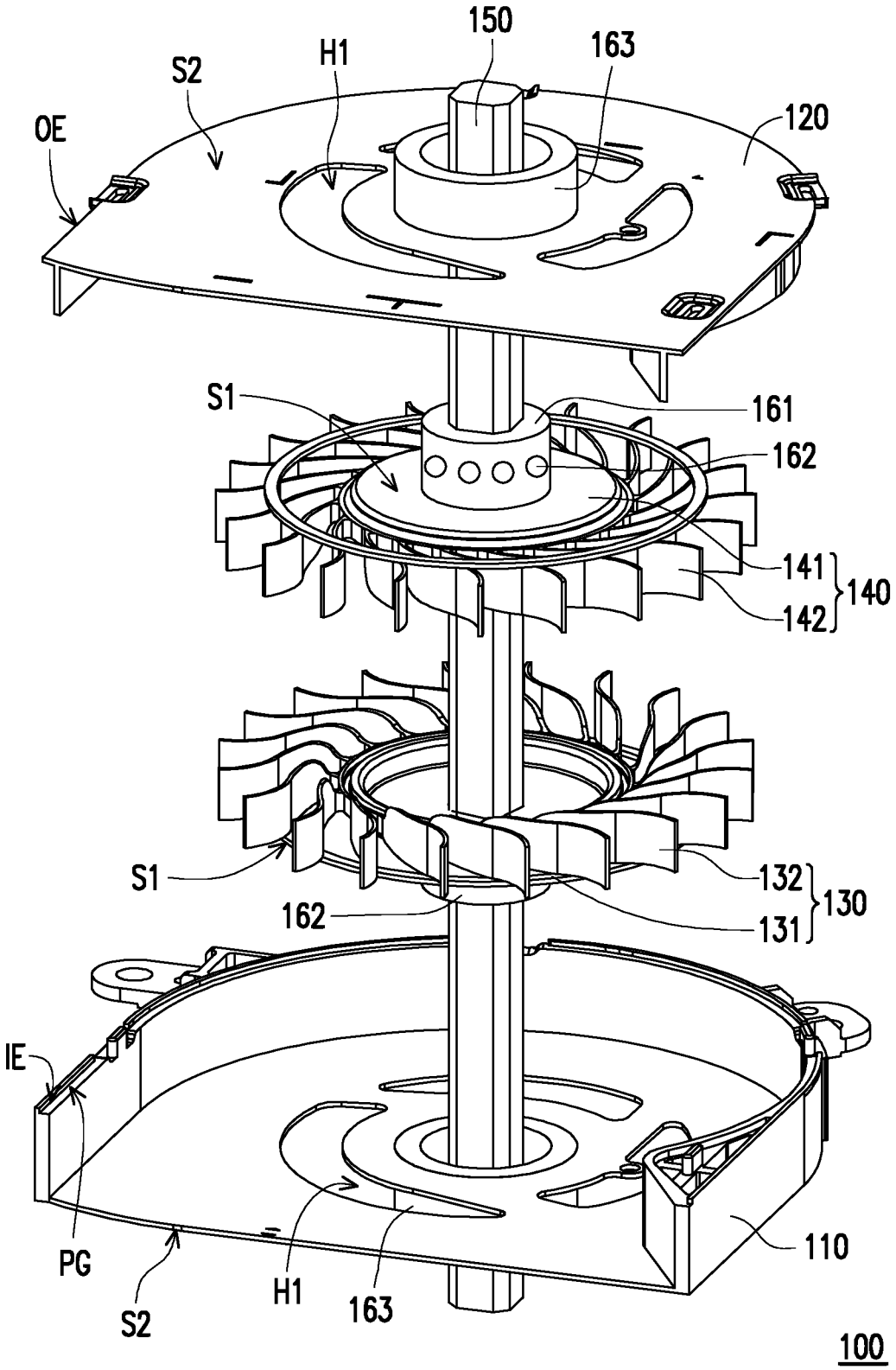
FIG. 2A is a schematic exploded view of components of the thermal module of FIG. 1A.
Figure 2B:
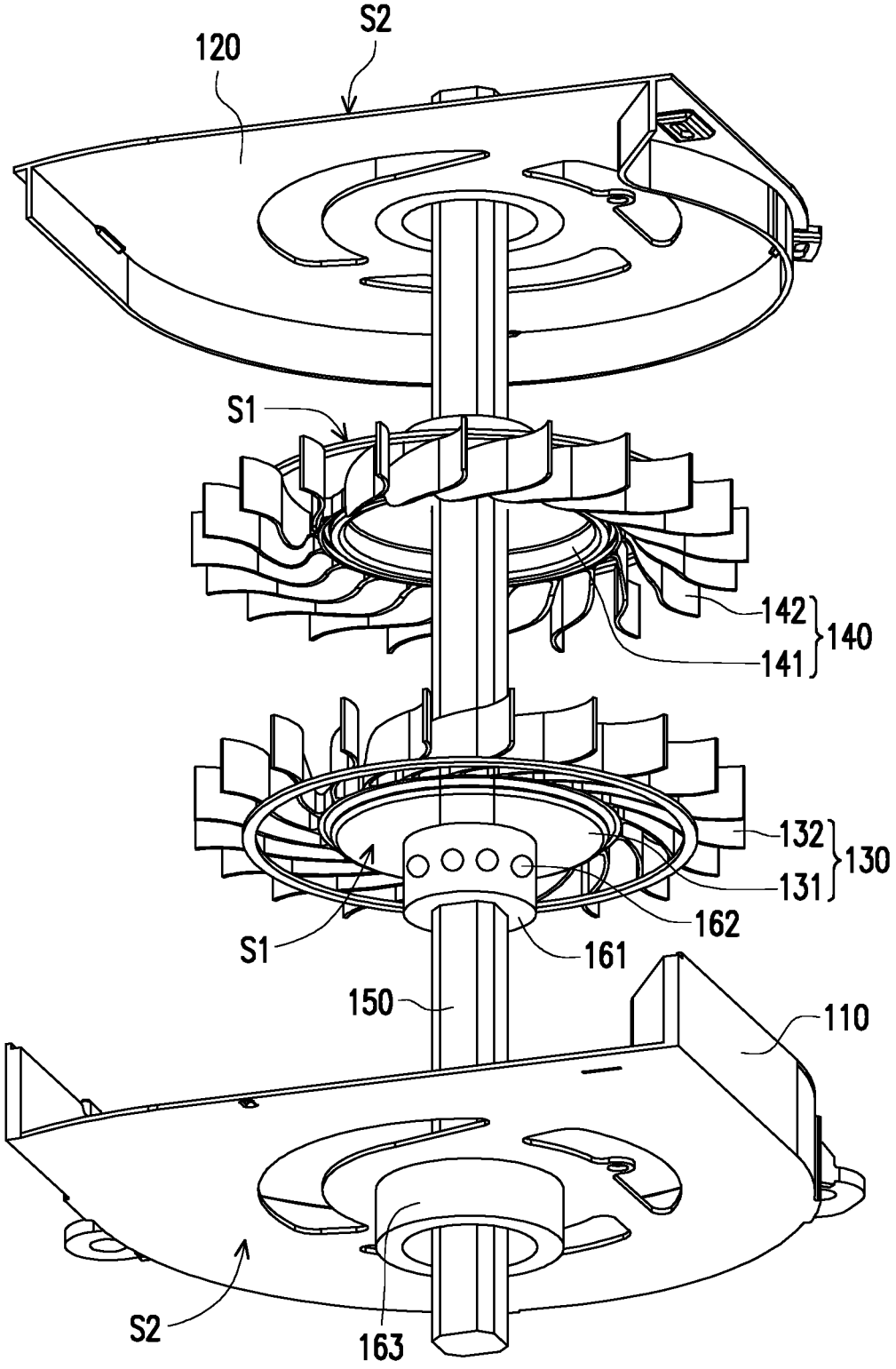
FIG. 2B is a schematic exploded view of the components of the thermal module of FIG. 1A in another direction.

FIG. 1A is a schematic three-dimensional view of a thermal module according to an embodiment of the disclosure. FIG. 1B is a three-dimensional view of the thermal module of FIG. 1A in another direction. FIG. 1C is top plan view of the thermal module of FIG. 1A. FIG. 2A is a schematic exploded view of components of the thermal module of FIG. 1A. FIG. 2B is a schematic exploded view of the components of the thermal module of FIG. 1A in another direction.

With reference to FIG. 1A to FIG. 1C, a thermal module 100 provided by the disclosure is adapted to be disposed in any electronic apparatus (e.g., a notebook computer or other similar apparatuses) that may generate waste heat and is configured to exhaust the waste heat generated by the electronic apparatus during operation.

In this embodiment, the thermal module 100 is, for example, a variable fan and includes a first body 110, a second body 120, a first fan assembly 130, a second fan assembly 140, a shaft 150, and two bearings 160. The first body 110 and the second body 120 are slidably connected to each other and form an accommodating space AS together.

With reference to FIG. 2A and FIG. 2B, specifically, the first body 110 is adapted to accommodate the second body 120. That is, an inner edge dimension of the first body 110 is greater than an outer edge dimension of the second body 120. A positioning groove PG is formed at an inner edge IE of the first body 110. In a folded state, an outer edge OE of the second body 120 is adapted to be engaged in the positioning groove PG.

Further, the first body 110 has a plurality of protrusions 111, and the second body 120 has a plurality of recesses 121. In the folded state, each of the protrusions 111 penetrates each of the corresponding recesses 121 to position the first body 110 and the second body 120.

A plurality of ventilation holes H1 are further included and are respectively formed on the first body 110 and the second body 120 to communicate with the accommodating space AS. Moreover, the ventilation holes H1 surround an outer side of the shaft 150 and are respectively aligned with the first fan assembly 130 and the second fan assembly 140. An exhaust outlet H2 is further included, is formed on lateral sides of the first body 110 and the second body 120, and communicates with the accommodating space AS.

The first fan assembly 130 is disposed in the accommodating space AS and has a first hub 131 and a plurality of first fan blades 132. The first hub 131 is connected to the first body 110, and the plurality of first fan blades 132 surround and are disposed on the first hub 131. The second fan assembly 140 is disposed in the accommodating space AS and has a second hub 141 and a plurality of second fan blades 142. The second hub 141 is connected to the second body 120, and the plurality of second fan blades 142 surround and are disposed on the second hub 141. The first hub 131 and the second hub 141 overlap each other, and the plurality of first fan blades 132 and the plurality of second fan blades 142 are arranged in an alternating manner.

Figure 3:
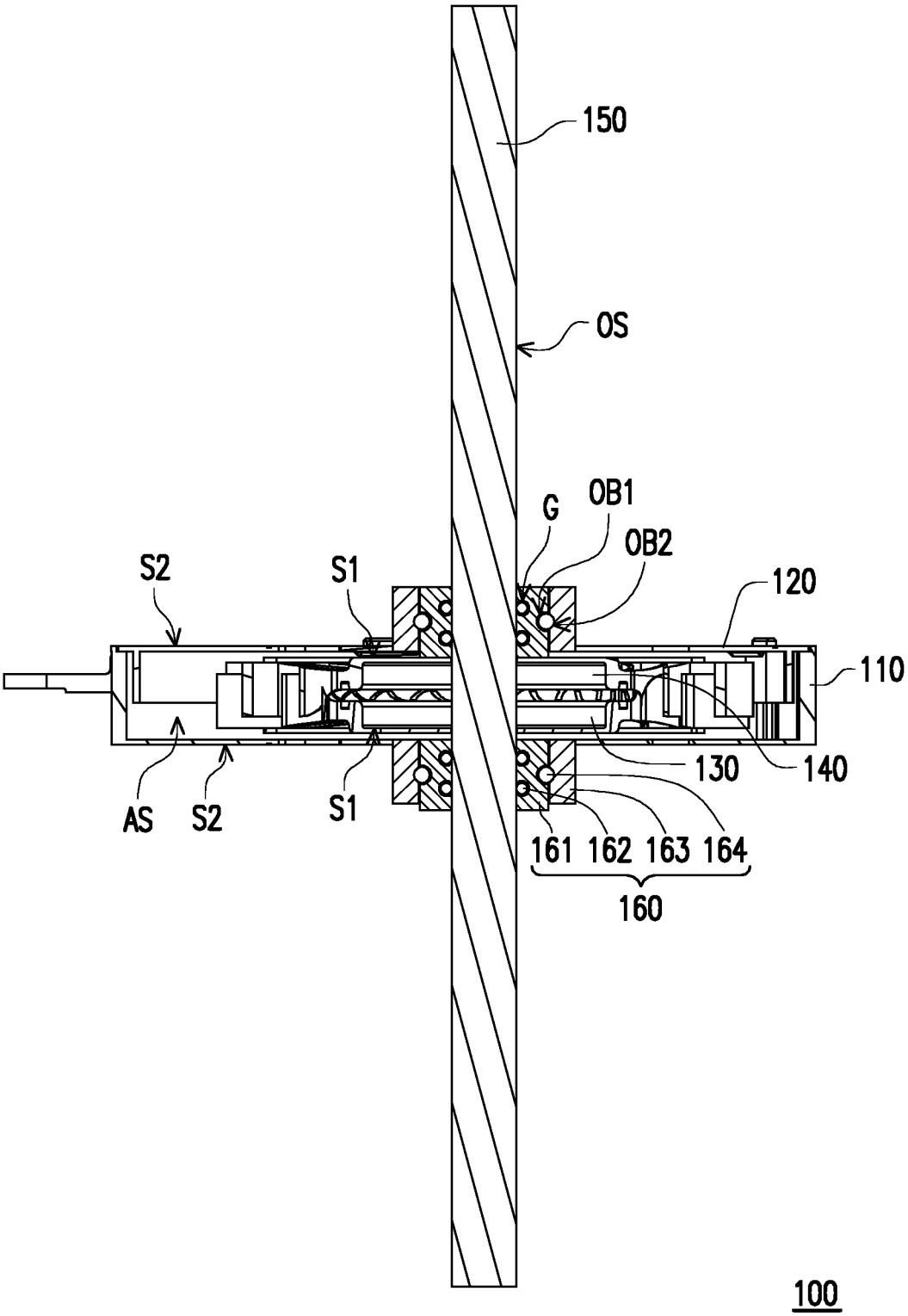
FIG. 3 is a schematic cross-sectional view of the thermal module of FIG. 1A.

FIG. 3 is a schematic cross-sectional view of the thermal module of FIG. 1A.

With reference to FIG. 3, the shaft 150 is pivotally disposed in the first body 110 and the second body 120 and is engaged with the first fan assembly 130 and the second fan assembly 140. That is, the shaft 150, the first fan assembly 130, and the second fan assembly 140 are integrally connected and are adapted to synchronously rotate. Further, two ends of the shaft 150 respectively protrude out of the first body 110 and the second body 120 and are configured to be connected to an external power source.

Figure 4A:
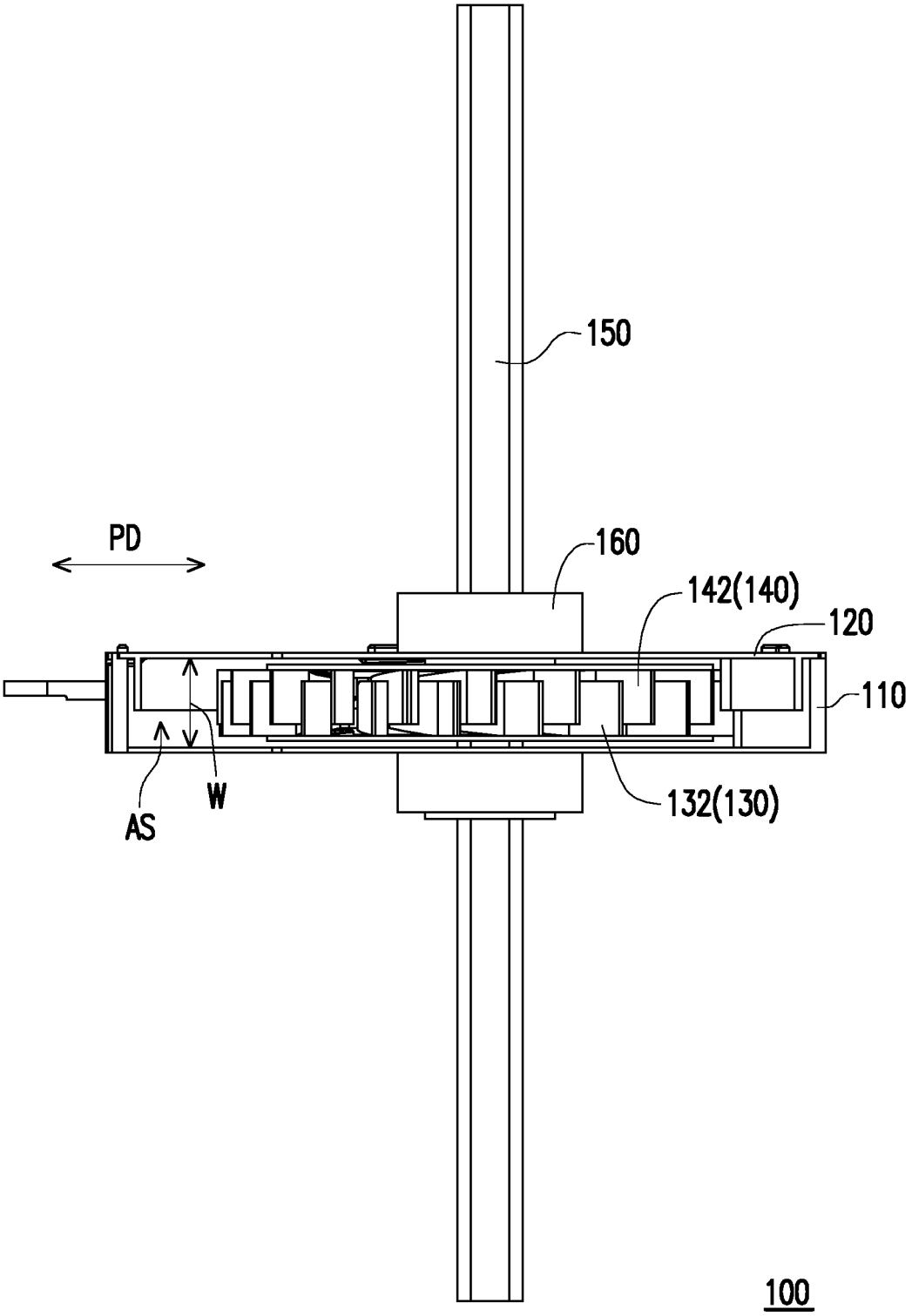
FIG. 4A is a schematic view of the thermal module of FIG. 1A in a folded state.
Figure 4B:
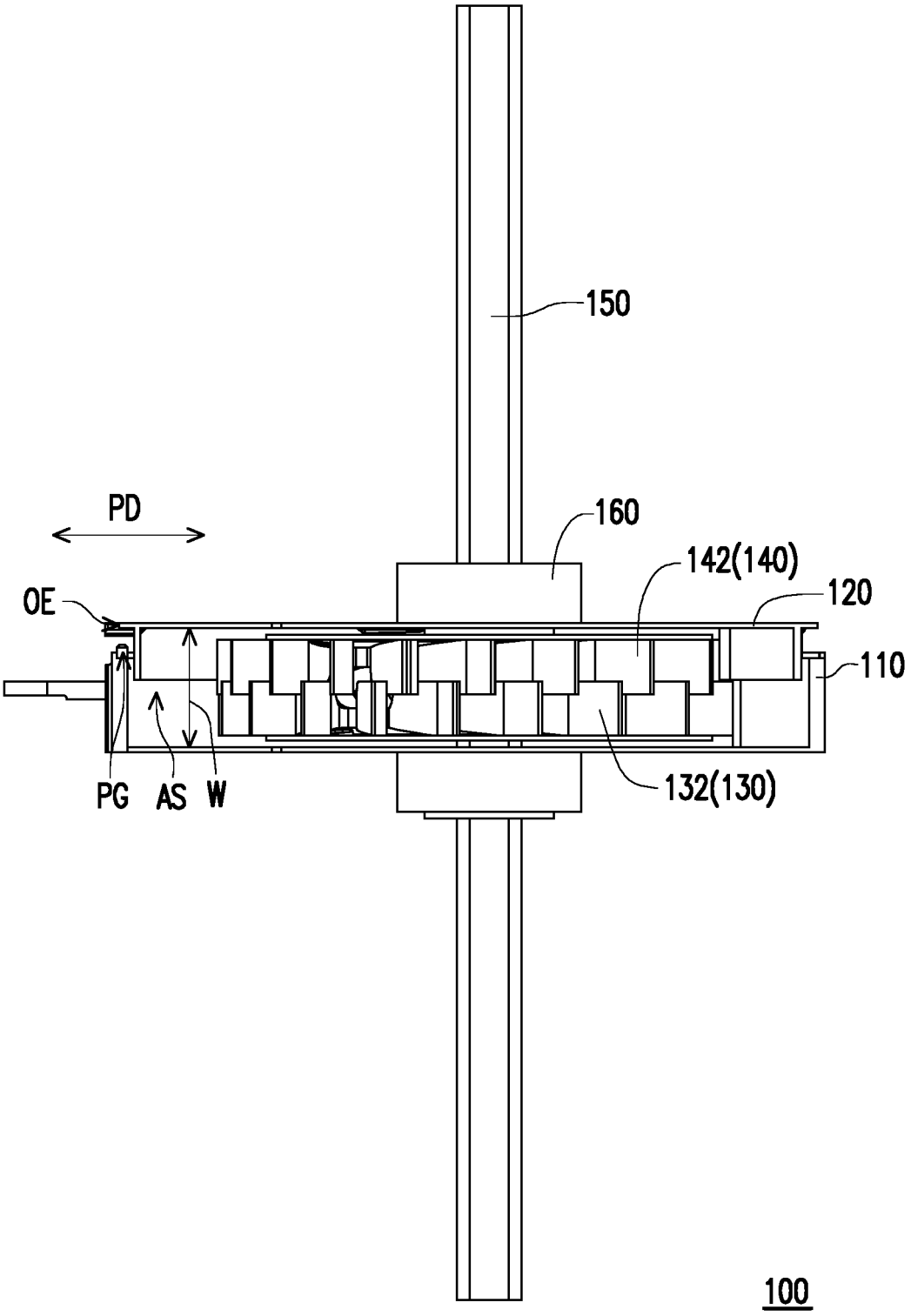
FIG. 4B is a schematic view of the thermal module of FIG. 1A in an unfolded state.

FIG. 4A is a schematic view of the thermal module of FIG. 1A in a folded state. FIG. 4B is a schematic view of the thermal module of FIG. 1A in an unfolded state.

With reference to FIG. 4A and FIG. 4B, when the external power source drives the shaft 150 to begin rotating, the shaft 150 is adapted to pivot relative to the first body 110 and the second body 120 to drive the first fan assembly 130 and the second fan assembly 140 to synchronously rotate. In this way, cold air in the environment is drawn into the accommodating space AS and hot air is exhausted into the environment from the exhaust outlet H2, and the heat dissipation effect is thereby achieved.

Further, the first body 110 and the second body 120 are adapted to receive an external force F to relatively slide (i.e., to approach each other or to move away from each other) and drive the first fan assembly 130 and the second fan assembly 140 to oppositely move along the shaft 150 to be switched to the folded state or the unfolded state.

With reference to FIG. 1A to FIG. 1C and FIG. 2A to FIG. 3, the thermal module 100 further includes two bearings 160 respectively disposed on the first body 110 and the first fan assembly 130 and the second body 120 and the second fan assembly 140. The shaft 150 is adapted to drive each of the bearings 160 to relatively rotate.

Each of the bearings 160 includes two inner rings 161 and a plurality of inner balls 162. The two inner rings 161 are respectively disposed on two surfaces 51 of the first hub 131 and the second hub 141 away from each other. The two inner rings 161 are sleeved on the shaft 150 and are configured to limit rotation of the shaft 150 relative to the first hub 131 and the second hub 141. Specifically, a plurality of grooves G are formed on an inner side surface of each of the inner rings 161, and the plurality of inner balls 162 are respectively disposed in the corresponding plurality of grooves G and are in contact with an outer wall surface OS of the shaft 150, such that each of the inner rings 161 and the shaft 150 are adapted to relatively move. That is, the inner rings 161 may linearly move facing each other along the shaft 150 through the plurality of inner balls 162.

In addition, in this embodiment, the shaft 150 is shaped as a polygonal cylinder and thus is engaged with the two inner rings 161, so that the shaft 150, the two inner rings 161, the first hub 131, and the second hub 141 synchronously pivot. In other embodiments, the shaft is, for example, shaped as a polygonal cylinder and drives the two inner rings, the first hub, and the second hub to synchronously pivot through other fixing manners.

Each of the bearings 160 includes two outer rings 163 and a plurality of outer balls 164. The two outer rings 163 are respectively disposed on two surfaces S2 of the first hub 110 and the second hub 120 away from each other. The two outer rings 163 are respectively sleeved on the two inner rings 161 and are configured to limit relative movement of the first hub 131, the second hub 141 and the first body 110, the second body 120. A first sliding rail OB1 is formed on an outer side surface of each of the inner rings 161, and a second sliding rail OB2 is formed on an inner side surface of each of the outer rings 163. The plurality of outer balls 164 are respectively disposed between the corresponding first sliding rails OB1 and the second sliding rails OB2, such that each of the inner rings 161 and each of the outer rings 163 are adapted to relatively rotate through the plurality of outer balls 164 disposed therebetween.

In this embodiment, when the shaft 150 drives the two inner rings 161, the first hub 131, and the second hub 141, the two outer rings 163 are respectively secured on the first body 110 and the second body 120. As such, the first hub 131 and the second hub 141 may rotate in the accommodating space AS for heat dissipation.

With reference to FIG. 2A, FIG. 3, FIG. 4A, and FIG. 4B, when the heat dissipation module 100 is switched to the folded state, the outer edge OE of the second body 120 is engaged with the positioning groove PG of the first body 110, so that the accommodating space AS is reduced. Moreover, the first hub 131 and the second hub 141 are in contact with each other, and at the same time, the plurality of first fan blades 132 and the plurality of second fan blades 142 overlap each other in a horizontal direction PD.

When the thermal module 100 is switched to the unfolded state, the outer edge OE of the second body 120 is separated from the positioning groove PG of the first body 110, so that the accommodating space AS is expanded. Moreover, the first hub 131 and the second hub 141 are separated from each other, and at the same time, the plurality of first fan blades 132 and the plurality of second fan blades 142 are separated from each other in the horizontal direction PD.

In addition, in the folded state, a width W of the accommodating space AS is reduced, so that the effect of miniaturization is achieved. In the unfolded state, the width W of the accommodating space AS expands, so that air intake of the thermal module 100 increases, and efficiency of heat dissipation is thereby enhanced.

Figure 5:
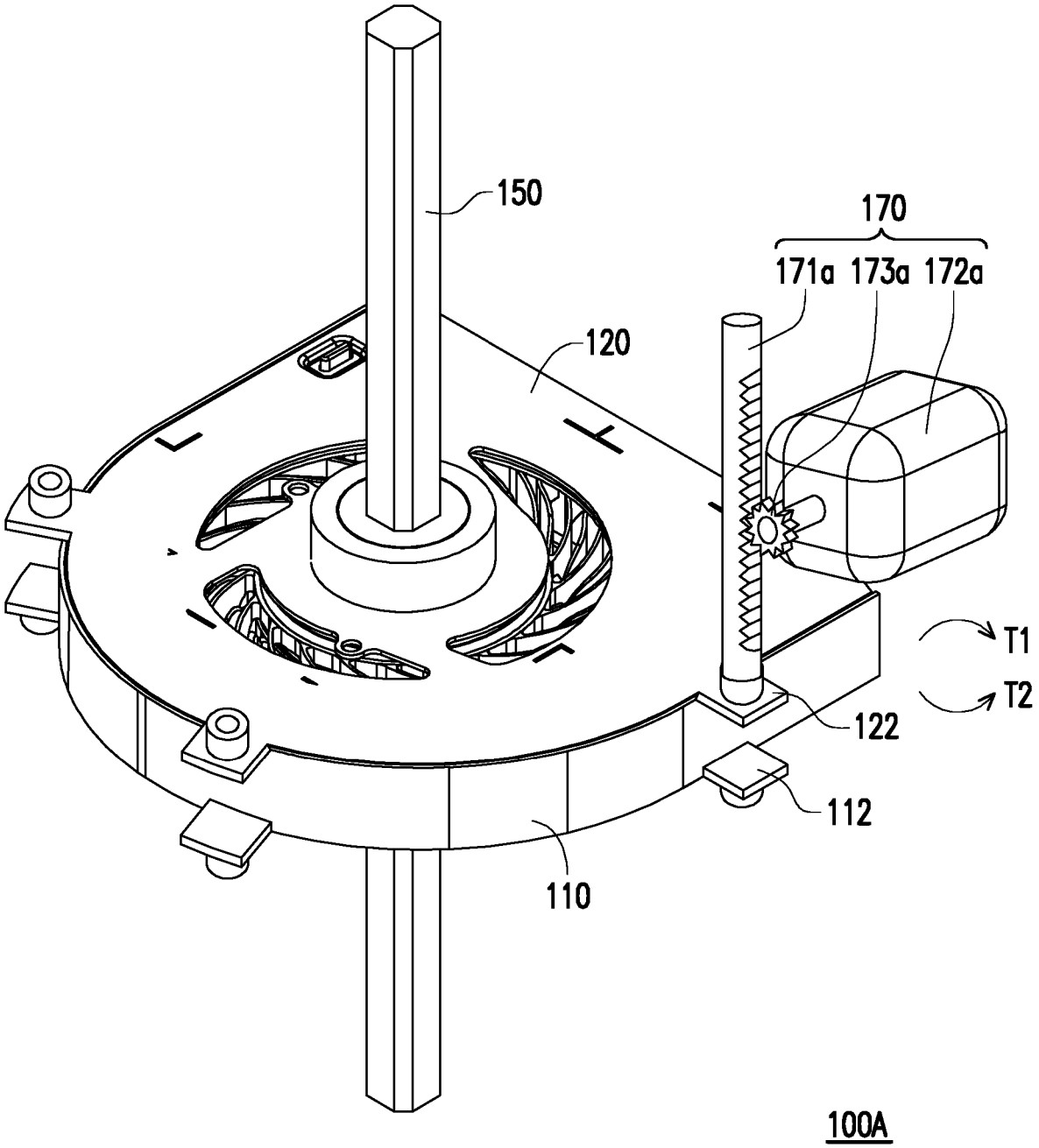
FIG. 5 is a schematic three-dimensional view of a thermal module according to another embodiment of the disclosure.
Figure 6:
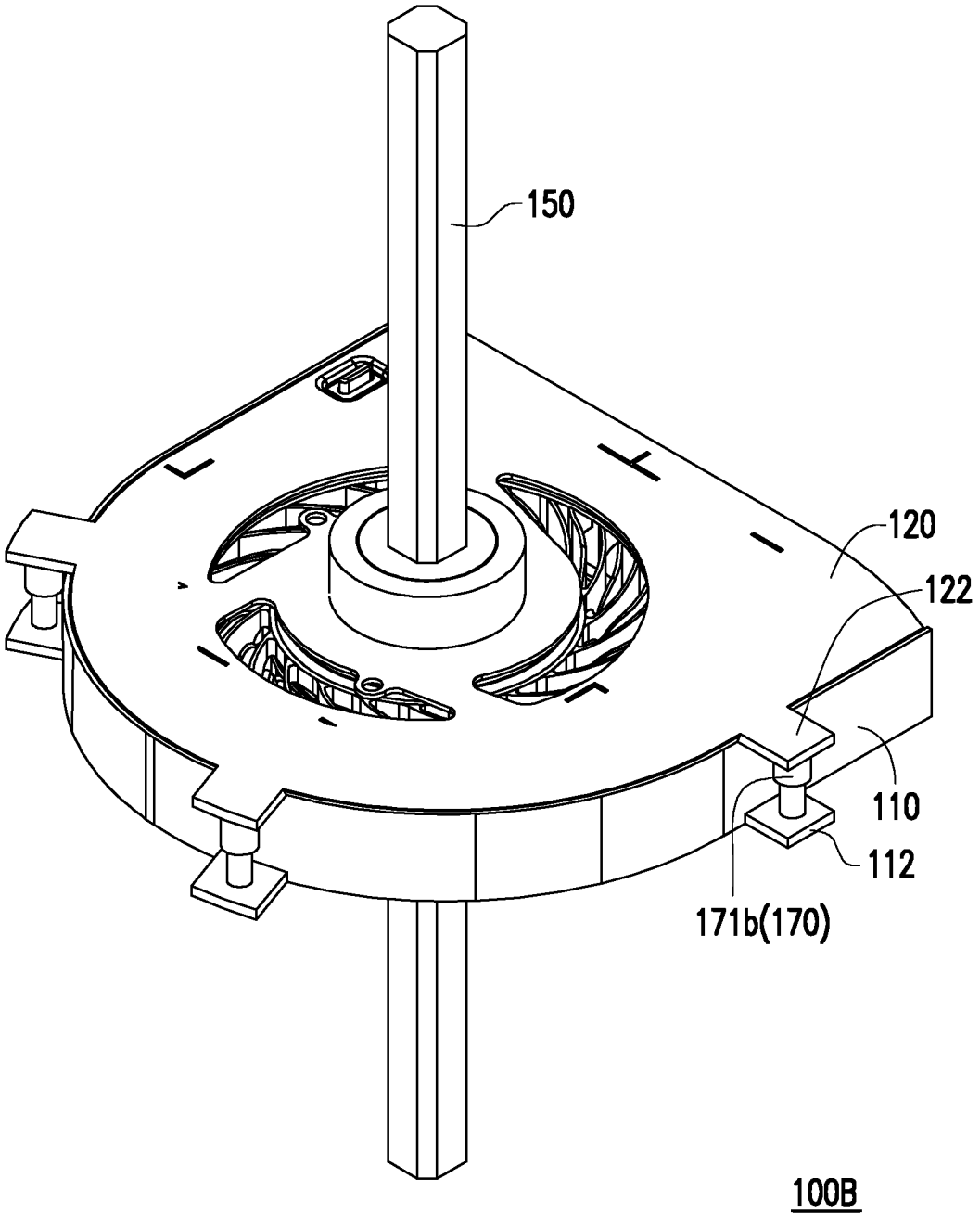
FIG. 6 is a schematic three-dimensional view of a thermal module according to another embodiment of the disclosure.

FIG. 5 is a schematic three-dimensional view of a thermal module according to another embodiment of the disclosure. FIG. 6 is a schematic three-dimensional view of a thermal module according to another embodiment of the disclosure.

With reference to FIG. 5 and FIG. 6, each of thermal modules 100A and 100B of this embodiment further includes a driving module 170 connected to the first body 110 or the second body 120 and adapted to generate the external force F to drive the first body 110 and the second body 120 to relatively move. The first body 110 and the second body 120 respectively include a plurality of driven connection points 112 and 122.

With reference to the embodiment shown by FIG. 5, the driving module 170 includes at least one rack 171*a* and at least one motor 172*a*. The at least one rack 171*a* is connected to one of the driven connection points 112, 122 of the first body 110 or the second body 120, and at least one pinion 173*a* of the at least one motor 172*a* meshes with the at least one rack 171*a*. The at least one motor 172*a* is adapted to drive the at least one pinion 173*a* to pivot towards a first rotating direction T1 or a second rotating direction T2, so as to drive the first body 110 and the second body 120 to relatively move through the at least one rack 171*a*.

In other embodiments, the driving module includes a plurality of racks and a plurality of motors. Moreover, each of the racks is connected to each of the corresponding driven connection points, and the pinion of each of the motors meshes with each of the corresponding racks. The first body and the second body may thereby be synchronously driven when the thermal module works.

With reference to the embodiment shown by FIG. 6, the driving module 170 includes a plurality of active screws 171*b*. Each of the active screws 171*b* is respectively connected to the two corresponding driven connection points 112 and 122. The plurality of active screws 171*b* are adapted to drive the first body 110 and the second body 120 to separate from each other or to approach each other.

In view of the foregoing, in the thermal module provided by the disclosure, the first body and the second body are adapted to relatively slide, so as to respectively drive the first fan assembly and the second fan assembly to relatively move along the shaft. When the thermal module is switched to the folded state, the cross-sectional area of the accommodating space is reduced and the first fan assembly and the second fan assembly overlap each other, so that the demand for miniaturization is achieved. When the thermal module is switched to the unfolded state, the cross-sectional area of the accommodating space is expanded and the first fan assembly and the second fan assembly separate each other, so that air intake increases and the demand for high heat dissipation efficiency is achieved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A thermal module, comprising:

a first body and a second body, slidably connected to each other and forming an accommodating space together;

a first fan assembly, disposed in the accommodating space, having a first hub and a plurality of first fan blades, the first hub connected to the first body;

a second fan assembly, disposed in the accommodating space, having a second hub and a plurality of second fan blades, the second hub connected to the second body a shaft rotationally disposed in the first body and the second body, engaged with the first fan assembly and the second fan assembly, wherein the first hub and the second hub overlapping each other when viewed along an axis of the shaft; and a driving module, comprising at least one motor, connected to the first body or the second body, wherein the shaft is adapted to rotate relative to the first body and the second body to drive the first fan assembly and the second fan assembly to synchronously rotate, and the driving module is configured to drive the first body and the second body to be relatively slid and drive the first fan assembly and the second fan assembly to oppositely move along the shaft to be switched to a folded state or an unfolded state.

2. The thermal module as claimed in claim 1, further comprising two bearings, respectively disposed in the first body and the first fan assembly and the second body and the second fan assembly, wherein the shaft is adapted to drive each of the bearings to relatively rotate.

3. The thermal module as claimed in claim 2, wherein each the bearings comprise two inner rings, one of the two inner rings is disposed on a surface of the first hub, the other one of the two inner rings is disposed on a surface of the second hub, and the two inner rings are sleeved on the shaft and are configured to limit rotation of the shaft relative to the first hub and the second hub.

4. The thermal module as claimed in claim 3, wherein a plurality of grooves are formed on an inner side surface of each of the inner rings, and a plurality of inner balls are respectively disposed in the corresponding plurality of grooves and are in contact with an outer wall surface of the shaft, such that each of the inner rings and the shaft are adapted to relatively move.

5. The thermal module as claimed in claim 3, wherein each the bearings comprise two outer rings, one of the two outer rings is disposed on a surface of the first body, the other one of the two outer rings is disposed on a surface of the second body, and the two outer rings are respectively sleeved on the two inner rings and are configured to limit relative movement of the first hub, the second hub and the first body, the second body.

6. The thermal module as claimed in claim 5, wherein a first sliding rail is formed on an outer side surface of each of the inner rings, a second sliding rail is formed on an inner side surface of each of the outer rings, and a plurality of outer balls are respectively disposed between each of the corresponding first sliding rails and each of the corresponding second sliding rails, such that each of the inner rings and each of the outer rings are adapted to relatively rotate.

7. The thermal module as claimed in claim 1, wherein a positioning groove is formed at an inner edge of the first body, and an outer edge of the second body is engaged with the positioning groove of the first body so that the accommodating space is reduced when the thermal module is switched to the folded state.

8. The thermal module as claimed in claim 7, wherein the outer edge of the second body is separated from the positioning groove of the first body so that the accommodating space expands and the first hub and the second hub are separated from each other when the thermal module is switched to the unfolded state.

9. The thermal module as claimed in claim 1, wherein the shaft is shaped as a polygonal cylinder or an ellipse.

10. The thermal module as claimed in claim 1, wherein the first fan blades and the second fan blades are arranged in an alternating manner.

11. The thermal module as claimed in claim 1, wherein the first body has a plurality of protrusions, the second body has a plurality of recesses, and each of the protrusions penetrates each of the corresponding recesses to position the first body and the second body in the folded state.

12. The thermal module as claimed in claim 1, wherein the thermal module further comprises a plurality of ventilation holes, the ventilation holes are respectively formed on the first body and the second body to communicate with the accommodating space, and the ventilation holes surround an outer side of the shaft.

13. The thermal module as claimed in claim 1, wherein the thermal module further comprises an exhaust outlet, and the exhaust outlet is formed on lateral sides of the first body and the second body and communicates with the accommodating space.

14. The thermal module as claimed in claim 1, wherein the driving module further comprises at least one rack, the at least one rack is connected to the first body or the second body, and a pinion of the at least one motor meshes with the at least one rack.

15. The thermal module as claimed in claim 1, wherein the driving module further comprises a plurality of active screws connected between the first body and the second body.

* * * * *